United States Patent [19]

Dwek

[11] 4,109,838

[45] Aug. 29, 1978

[54] GARMENT HANGER

[76] Inventor: Abraham Dwek, 718 Avenue R, Brooklyn, N.Y. 11223

[21] Appl. No.: 820,764

[22] Filed: Aug. 1, 1977

[51] Int. Cl.[2] ..... A47J 51/14

[52] U.S. Cl. ..... 223/91; 223/92

[58] Field of Search ..... 223/88, 91, 92, 87, 223/85, 68, 66, 96; 211/113, 119

[56] References Cited

U.S. PATENT DOCUMENTS

| | | | |
|---|---|---|---|
| 1,332,146 | 2/1920 | Riordan et al. | 223/68 |
| 2,042,240 | 5/1936 | Shaffer | 223/91 |
| 2,536,187 | 1/1951 | Kosky et al. | 223/92 |
| 2,609,977 | 9/1952 | Lausch | 223/92 |
| 2,998,903 | 9/1961 | Day | 223/92 |
| 3,406,882 | 10/1968 | Phillips | 223/88 |

FOREIGN PATENT DOCUMENTS

| | | | |
|---|---|---|---|
| 601,468 | 1/1960 | Italy | 223/85 |

*Primary Examiner*—George H. Krizmanich
*Attorney, Agent, or Firm*—Friedman, Goodman & Teitelbaum

[57] ABSTRACT

A garment hanger having a hook portion with a pair of shoulders depending from the hook portion. Sidewalls extend downwardly from the shoulders and a bottom rib extends across the bottom to complete a closed hanger structure. The shoulders, hook, sidewalls and bottom rib all lie in a common plane. At least one arcuate rib is connected between the sidewalls and bows outwardly in a lateral direction from the common plane to provide form and shape to a garment placed on the hanger for display.

7 Claims, 9 Drawing Figures

GARMENT HANGER

BACKGROUND OF THE INVENTION

This invention relates to a garment hanger and more particularly to a hanger which will support and display garments in a more attractive manner.

Garment hangers and variations thereof are well known in the art. Some garment hangers are used by individuals for home use, while others are utilized for display by manufacturers or distributors. In the past, little distinction has been made between the garment hanger useful for individual home use and those hangers provided for display.

The basic concern heretofore addressed in connection with the manufacture of garment hangers, has been to provide the hanger with appropriate structure to support various parts of a garment. For example, heretofore, attention has been given to provide useful structure on the hanger to accommodate a two piece garment, such as a suit, or a skirt and blouse, or other types of garments having individual parts. U.S. Pat. No. 2,991,919 provides a two stepped arrangement for the lower portion of a garment which accommodates different waist sizes. In this manner, the waist is positioned tightly on the hanger and depends therefrom in an attractive manner. Similarly, U.S. Pat. No. 3,007,616 provides a hanger with angularly placed tabs depending from the lower frame of the hanger to accommodate different waist sizes of a pair of trousers. Also, this patent teaches the adjustment of the side portions of the hanger so that the distance, to which the pants depend beneath a supported jacket, can be changed.

Other patents similarly address the same problem of providing structure on the hanger to accommodate various parts of a garment. U.S. Pat. No. 3,087,660 provides a two stepped arrangement which can also support waisted garments of different sizes. U.S. Pat. No. 3,249,270 provides a hanger including a waist band support which permits the garment to be twisted around the support to thereby take up the slack and gather the extra material around the waist portion thereby providing a more aesthetic display of two piece garments.

While these patents have addressed the problem of accommodating the various parts of a garment having different sections, there is another problem in connection with the displaying of garments which is not at all addressed by these prior art hangers. When displaying a garment, the garment is hung on the hanger and placed on a display rod for viewing by the customer. The garment is designed to be worn by an individual who has shape and form and a thickness dimension. However, when hung on a regular hanger, or other garment support means, the garment will hang in a flat manner without any form or shape and will tend to droop or dangle as it is suspended from the hanger. This drooping provides a very unattractive and unappealing appearance to the customers.

In order to provide some body, shape and form to the article of clothing supported on the hanger, it has hithertofore been the practice to first add some padding, such as a tissue paper, regular paper, or even cardboard, to give some shape to the garment. The tissue paper or other shaping material, is placed either directly within the garment, such as in its sleeve or other enclosed portion, or is rather placed directly around the hanger by wrapping it around the sidewalls and the reinforcing ribs. After the tissue paper, or other shaping material is wrapped around the hanger, a sheet or cover in the form of a draping sheath is then placed on the hanger to cover the tissue paper, or other supporting material. On top of this covering sheath is finally placed the garment for display. By means of the tissue paper, or other supporting material wrapped around the hanger, there is provided some form, shape, and body substance to the garment hanging on the hanger to make it more attractive and eye appealing to the customer.

However, the wrapping of the hanger provides a time consuming operation and frequently requires the use of a skilled designer to appropriately place the tissue paper or other supporting material at the proper locations for each garment. For example, in hanging a suit jacket, a form or shape is needed in the upper shoulder portion while the lower portion can hang freely. When hanging a skirt, some tissue paper may be needed around the waist portion, and extra tissue paper may be needed around the hip portion. This requires time, experience, and skill to apropriately place the tissue paper on the hanger to obtain the proper form and shape needed for a specific garment.

SUMMARY OF THE INVENTION

It is therefore an object of the present invention to provide a garment hanger which avoids the aforementioned problems of prior art devices.

Another object of the present invention is to provide a garment hanger which can provide a more eye appealing, attractive, and aesthetic display of garments.

Another object of the present invention is to provide a garment hanger which can inherently provide form and shape to a garment placed on the hanger.

Another object of the present invention is to provide a garment hanger which can accommodate garments having more than one piece, and wherein appropriate form and shape is provided to each portion of the garment.

Yet a further object of the present invention is to provide a garment hanger which can provide form and shape to a garment, both to the front and back of the garment.

A further object of the present invention is to provide a garment hanger which includes arcuately bowed ribs which provide form and shape to a garment hung on the hanger.

Yet a further object of the present invention is to provide a garment hanger which can be easily manufactured and easily shipped, and yet provides inherent form and shape to a garment being displayed on the hanger.

Briefly, the invention provides for a garment hanger including a pair of transversely extending shoulders. A hook is provided and is coupled between the transversely extending shoulders to support the garment hanger from a display rod. Sidewalls extend downwardly from the transversely extending shoulders. The shoulders, as well as the sidewalls, and the hook all lie in a common plane. At least one arcuate rib is connected between these sidewalls. The arcuate rib bows outwardly in a lateral direction from the common plane, to thereby provide a projection against the garment hanging on the hanger. This rib provides form and shape to the garment placed on the hanger.

In an embodiment of the invention, arcuate ribs can be provided both towards the front and rear of the hanger. The hanger can be constructed of two substantially identical shaped parts, one having an arcuate rib bowing toward the front and the other having an arcuate rib bowing toward the back. In order to permit easy transportation and shipping of these hangers, the two identical parts are formed and shipped separately, and are assembled by the user prior to use by means of coupling devices.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DESCRIPTION OF THE PREFERRED EMBODIMENTS

Figure 1:
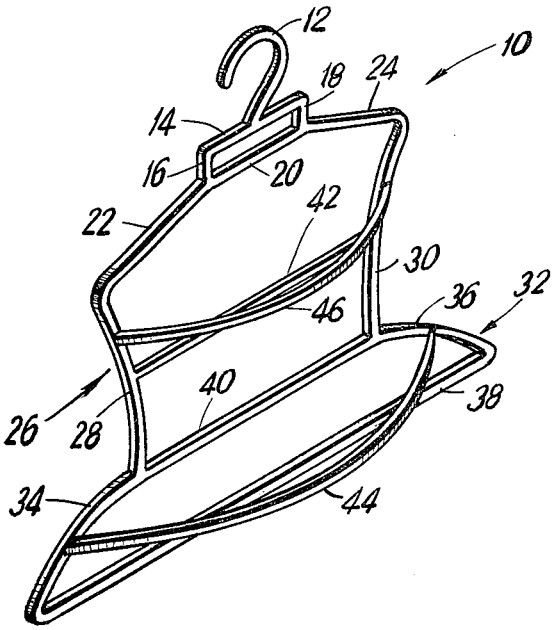
FIG. 1 is an isometric view of a first embodiment of the garment hanger of the present invention.
Figure 2:
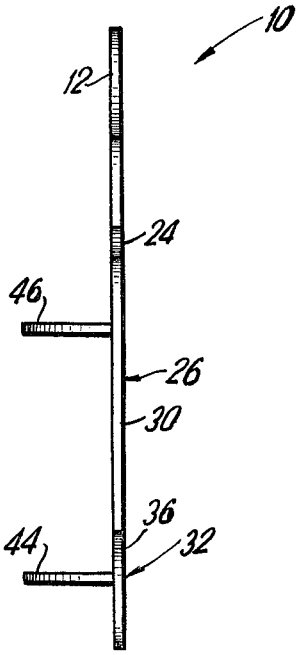
FIG. 2 is a side view of the hanger shown in FIG. 1.

Referring now to the drawings, and specifically FIGS. 1 and 2, there is shown a hanger 10 which includes a hook 12 from which the hanger can be supported from a display rod. Extending from the hook is a horizontal transverse section 14 providing a support for the hook. Downwardly depending sections 16, 18 extend from the support 14 and are interconnected by a reinforcing rib 20 to thereby provide a firm base support for the hook.

Extending downwardly and outwardly from the hook support rib 20 are a pair of transverse shoulders 22, 24 on which a garment is placed and supported. Integral with these shoulders, and downwardly depending therefrom, are sidewalls or side members which form the frame of the hanger. The sidewalls include an upper portion 26 formed of first arms 28, 30 which respectively extend downwardly from the transverse shoulders. A lower portion 32 of the sidewalls includes additional arms 34, 36 which respectively extend from the first arms 28, 30. The lower portion 32, and specifically the arms thereof, extend outwardly to thereby accommodate the appropriate shape of various garments. A lower base member 38 interconnects the bottom ends of the arms 34, 36 to provide reinforcement to the hanger and thus provide a closed hanger structure. Additional reinforcing ribs, such as ribs or bars 40, 42 are provided transversely across the hanger, and interconnect various sections of the sidewalls. As shown in FIG. 1, the interconnecting rib 40 is positioned at the junction between the upper portion 26 and the lower portion 32. The additional rib 42 is placed between the upper arms forming the upper portion 26.

The shoulders 22, 24, the arms 28, 30, as well as the hook 12, and the arms 34, 36 with its supporting base member 38, and including all of the heretofore mentioned interconnecting reinforcing ribs 40, 42, all lie in a common plane, as is typical with heretofore designed hangers. However, a garment placed upon such a hanger would drape downwardly providing a drooping form which would provide an unattractive display of the garment. In order to provide form and shape to such displayed garment, it had been heretofore the practice to provide some form of support material, such as tissue paper, which would typically be wrapped around various parts of the hanger. For example, tissue paper would be wrapped around the reinforcing ribs 40, 42 as well as other reinforcing ribs, and additional tissue paper might be wrapped around some of the sidewalls including the arms 34, 36, as well as other parts of the hanger. Over the tissue paper there would be draped a sheath providing a cover for the tissue paper and a smooth supporting surface for the garment. The garment would then be placed over the sheath and the tissue paper would provide the necessary body and support to give an aesthetic and attractive appearance to the display of the garment.

The present invention provides for arcuately shaped ribs 44, 46 which interconnect between the sidewalls, and are outwardly bowed in a lateral direction from the common plane in which the remaining parts of the hanger lie. Specifically, the rib 46 is interconnected between the arms 28, 30 and bows outwardly in a front direction, as viewed in FIG. 1. The arcuate rib 44 interconnects the lower arms 34, 36 and also bows outwardly toward the front of the hanger.

The garment hanger shown in FIG. 1, would be useful for a dress or similar shaped garment. The top portion of the hanger is narrow for providing suitable support for the shoulders of the garment, and the lower portion of the hanger is wider, being outwardly directed, to thereby provide the necessary width to the lower part of a dress hanging on the hanger. The arcuate ribs are placed at the appropriate portions to provide the necessary shape and form for the dress. It should be noted, that for various garments, the arcuate shaped ribs could be placed at other positions to accommodate the best aesthetic appearance of the garment.

Figure 3:
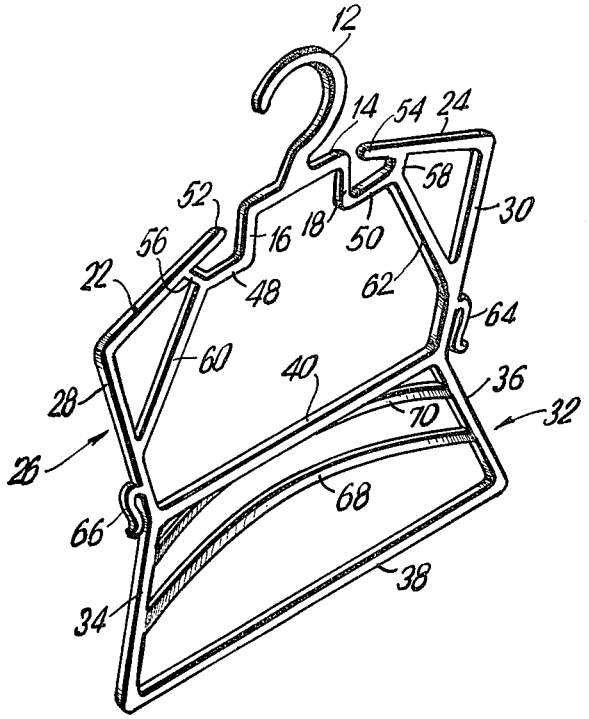
FIG. 3 is a isometric view of a second embodiment of the garment hanger of the present invention.
Figure 4:
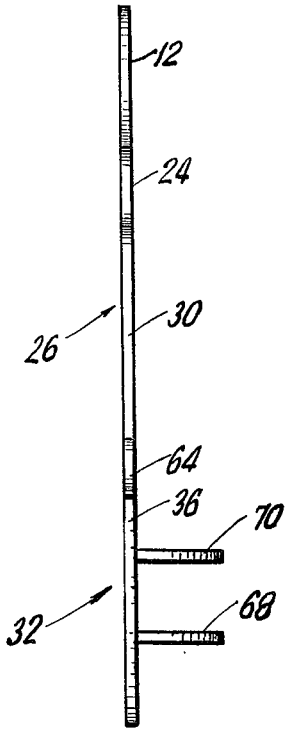
FIG. 4 is a side view of the garment hanger shown in FIG. 3.

Referring now to FIGS. 3 and 4, there is shown an alternate type of hanger which might be suitable to receive a one piece garment, such as a sunsuit with straps, or a two piece garment, such as a skirt and blouse, or a shirt and short pants. The hanger shown in FIGS. 3 and 4 likewise includes the hook 12 with its support 14 and its downwardly depending sections 16 and 18. The additional reinforcing rib 20 of FIGS. 1 and 2 is not present in FIG. 3 since additional support is provided by the other hanger reinforcing structure in this embodiment, set forth below. Specifically, the downwardly depending sections 16 and 18, continue into the transverse sections 48, 50, which extend outwardly. The shoulders 22, 24 end in inwardly directed tips 52, 54, which are spaced over the lower transverse sections 48, 50. Strut 56 interconnects the shoulder 22 with the section 48 and corresponding strut 58 interconnects shoulder 24 with the section 50. These then form strap receiving receptacles whereby the straps of a swimsuit or a sunsuit, skirt, or straps from short pants can be hung in place and supported by the hanger.

Interconnected between the connected shoulder 22 and strut 56 and the upper arm 28 is provided an additional reinforcing strut 60, and correspondingly an additional reinforcing strut 62 interconnects the connected shoulder 24 and strut 58 with the arm 30. These struts provide additional support for the hanger. The reinforcing rib 40 is again placed between the upper portion 26 and the lower portion 32 of the hanger, and is parallel to the base member 38, as with regard to the previously described hanger structure.

In order to accommodate the holding of a pair of short pants or a skirt, there is provided waist band holding means proximate the junctions between the upper portion 26 and the lower portion 32. Specifically, these include the finger-like projections 64, 66. These projections extend outwardly from and run in the direction of the upper arms 28, 30 and include downwardly projecting fingers. At the mid points of the fingers, a clamp is formed between the inwardly directed fingers 64, 66 and the respective lower arms 34, 36, where the ends of the fingers extend outwardly to permit insertion therebetween. These fingers are formed of resilient material whereby the waist band of a trousers can first be inserted between the fingers and the arms 34, 36, and then further inserted to be held in place against the arms 28, 30.

Arcuately bowed ribs 68, 70 are provided on the lower portion of the hanger. Both ribs face the opposite side of the hanger, in this case bow outwardly toward the rear of the hanger, as seen looking into FIG. 3. The arcuately shaped bowed ribs 68, 70 are outwardly bowed in a lateral direction from the common plane in which all of the remaining parts of the hanger are positioned. These bowed ribs again form an appropriate body and shape for a suitable garment. In connection with the hanger shown in FIG. 3, the garment can support a one or two piece outfit, by utilizing the strap receiving apertures provided at the top of the hanger. Thus, an appropriate body and structure are provided to ensure an appropriate eye pleasing display of the garment.

Figure 5:
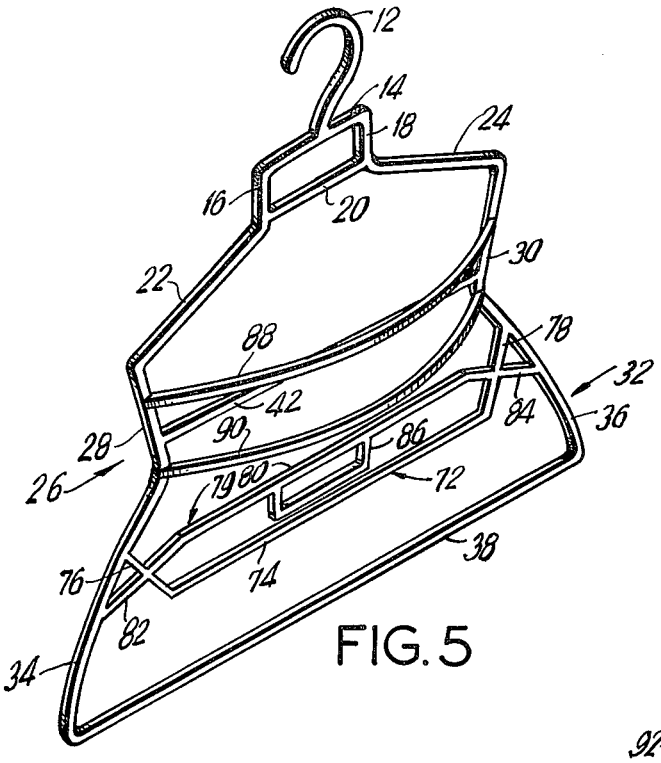
FIG. 5 is an isometric view of yet a third embodiment of the garment hanger of the present invention.
Figure 6:
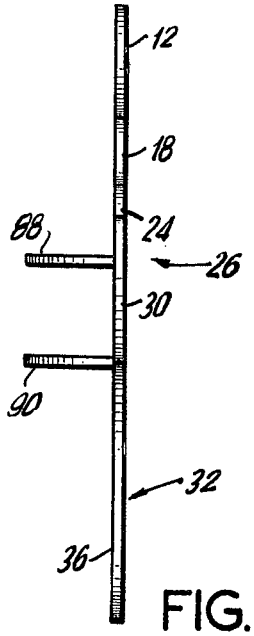
FIG. 6 is a side view of the garment hanger shown in FIG. 5.

FIGS. 5 and 6 provide yet a further embodiment of the invention also including the arcuate shaped ribs to provide body and structure to the garment. The top portion of the hanger shown in FIG. 5 is substantially similar to that shown in FIG. 1 and includes the hook 12, the shoulders 22, 24 and the upper portion 26 with its appropriately downwardly depending arms 28, 30 and interconnecting reinforcing rib 42. There is also included a lower portion 32 with its corresponding arms 34, 36 and its lowermost interconnecting base member 38. However, in the hanger shown in FIGS. 5 and 6, there is also provided an additional support for retaining a folded over garment, such as pants or a skirt. Specifically, there is provided a lower reinforcing rib 72 which extends between the arms 34, 36, which form the lower portion 32 of the hanger. The rib 72 includes a mid section 74 and upwardly extending side support sections or arms 76, 78. Spaced above the mid section 74 of the support rib 72 is an additional reinforcing rib 79 which includes a center portion 80 and side support sections or arms 82, 84. Rib 79 also extends between the arms 34, 36. However, the outer supporting arms 82, 84 are downwardly depending and cross the upwardly extending arms 76, 78 of the reinforcing rib 72. In this manner, the side support sections 76 and 82 cross each other in an X formation, and similarly the side support sections 78 and 84 cross each other in an X formation. At the respective interconnections, the side sections are coupled together. For example, they can both be made in an integral structure having a common interconnecting crossing section. The crossing of the side sections provides additional support for the reinforcing ribs.

A downwardly depending tongue portion 86, shown as a rectangular frame, depends from the center portion 80 of the rib 79 and extends until it almost contacts the rib 72, being slightly spaced therefrom. A pair of folded trousers would be placed over the mid section 74 of the lower rib 72 and would be held in place by the downwardly pressing tongue 86 which holds onto the trousers and prevents them from slipping off the bottom rib 72.

In the embodiment shown in FIG. 5, there is also provided arcuate ribs 88, 90, this time extending from the upper and middle portions of the hangers to provide proper shape and body to a garment placed on the hanger.

Heretofore, it has been shown that the arcuate ribs can be placed to extend outwardly in a direction from either the front or the back of the hanger to provide an appropriate shape. It is of course understood, that ribs could be provided both on the front and the back portion simultaneously to provide a desired shape for the garment. However, in that case, some problem might present itself concerning the proper shipping of the hanger. Utilizing the hanger shown in FIGS. 1-6, with the ribs being on only one side of the hanger, a group of hangers can be interfitted and stacked one against the other to be easily shipped. However, when providing arcuate shaped ribs extending outwardly from both front and back sides of the hanger, additional spaced would be required during shipping.

Figure 7:
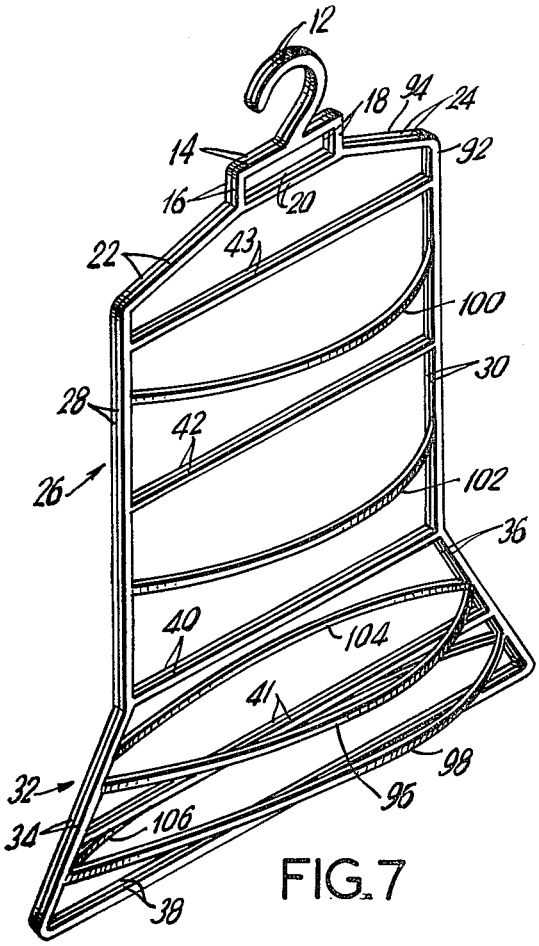
FIG. 7 is an isometric view of a further embodiment of the garment hanger of the present invention.
Figure 8:
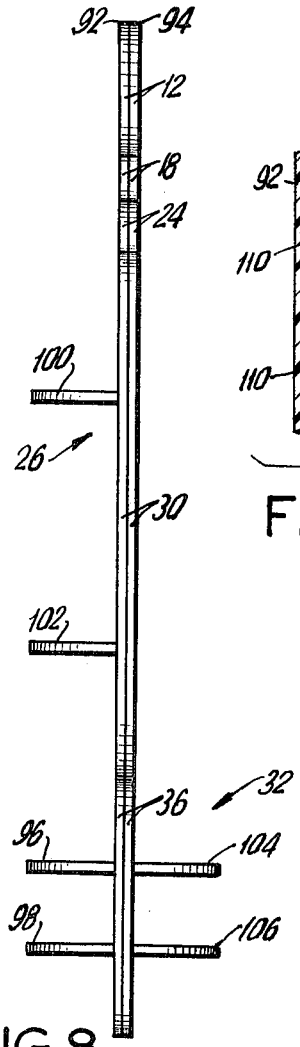
FIG. 8 is a side view of the garment hanger shown in FIG. 7.
Figure 9:
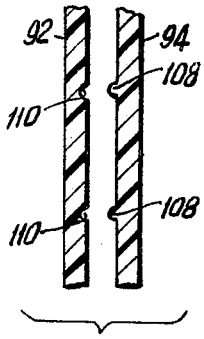
FIG. 9 is an exploded longitudinal sectional view of a portion of the structure shown in FIG. 8 and fragmentarily showing the two hanger sections separated from each other.

Referring now to FIGS. 7–9, there will be provided an embodiment which can be made easier to ship and yet provide front and back arcuate ribs for appropriate shaping of the garment. In this embodiment, there is provided two substantially identical hanger sections 92, 94. Each of the hanger sections includes a hook 12 at its top, an appropriate support 20 for the hook, transversely extending shoulders 22, 24 from the hook, as well as the sidewalls each including its upper portion 26 and its lower portion 32, and a base member 38. The hanger sections also include substantially identical interconnecting reinforcing ribs 40, 41, 42 and 43 transversely extending across the sidewalls. All of the elements forming the hanger section 92 lie in a first plane, while the elements forming the hanger section 94 lie in a second plane. The only difference between the hanger sections is in connection with the arcuate ribs. On the hanger section 92 there are formed the ribs 96, 98 which are placed near the bottom of the hanger and lie in a transverse plane to the common plane of hanger section 92 and face in a front direction, as seen in FIG. 7. Additionally, on the hanger section 92 there are placed a number of arcuate ribs 100 and 102 on the upper portion, which face in the same front direction as ribs 96, 98. On the other hand, on the hanger section 94 there are placed two arcuate ris 104 and 106 of the lower portion. However, these last two arcuately shaped ribs 104, 106 while being lateral to the common plane of the hanger 94, now face the rear of the hanger.

The two sections 92, 94 of the hanger can be manufactured separately and shipped separately. However, each of these sections are formed with interconnecting means. As for example, shown in FIG. 9, there is a number of dimple and socket arrangements with each dimple 108 being formed on one part of the hanger section 94 and each mating socket portion 110 being formed on the other section 92. The dimple and socket, which can be formed on either section in any combination thereof, will interfit and hold together the two sections 92, 94 thereby assembling that the two sections of the hanger. In this way, although the two sections of the hanger are initially manufactured separately and are shipped separately, the user can take the two parts and easily assemble them together by snapping each dimple into an associated socket thereby forming the two identical parts of the hanger into a single integral structure. Nevertheless, he will obtain the benefit of having both front and rear arcuate ribs to provide an appropriate shape for the garments he will place on the hanger.

It is noted, that the arcuate ribs may either extend outwardly from the front or rear surfaces of the sidewalls as indicated in FIGS. 1 and 5, or from the inner edges of the sidewalls as indicated in FIGS. 3 and 7.

Although the hanger can be formed of any other type of material, it has been found beneficial to make the hanger of a resilient pliable material, such as plastic. Furthermore, by using well known molding techniques, the hanger can be made in a single continuous unbroken length of pliable resilient material. Of course, wooden hangers as well as wire and cardboard hangers could similarly utilize the novel features of this invention.

While only a few variations of the hangers have been shown which can accommodate various parts of garments, as is well known, numerous other types and shapes of hangers are available for providing appropriate structure to hold parts of the garment, and these could also be utilized in conjunction with the arcuate ribs to provide appropriate body and shape.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A garment hanger comprising a pair of transversely extending shoulders, a hook coupled between said transversely extending shoulders to suspend the garment hanger, sidewalls extending downwardly from said transversely extending shoulders, said transversely extending shoulders and said sidewalls lying in a common plane, rib means connected between the sidewalls and being bowed outwardly in a lateral direction from said common plane to provide form and shape to a garment placed on the hanger, said rib means including at least one arcuate rib, said sidewalls having an upper portion and a lower portion, said upper portion including first arms downwardly depending from an end of each of said transversely extending shoulders, said lower portion including second arms downwardly depending and transversely extending from an end of each of said first arms, a first reinforcing rib being connected between said sidewalls and lying in said common plane, said first reinforcing rib being for supporting a garment folded thereover, a second reinforcing rib being connected between said sidewalls and lying in said common plane, said second reinforcing rib being spaced above said first reinforcing rib, a tongue portion downwardly depending in said common plane from said second rib, said tongue portion terminating adjacent to said first reinforcing rib for pressing onto the garment folded over said first reinforcing rib and preventing slippage of the folded garment therefrom.

2. A garment hanger as in claim 1, wherein said first reinforcing rib comprises a horizontal mid section and supporting side sections depending downwardly and inwardly from said sidewalls, said second reinforcing rib including a horizontal mid section and supporting side sections extending upwardly and inwardly from said sidewalls, said supporting side sections of said first reinforcing rib and said supporting side sections of said second reinforcing rib respectively crossing each other, and means interconnecting the supporting side sections crossing each other.

3. A garment hanger comprising a first pair of transversely extending shoulders, a first hook coupled between said first pair of shoulders to suspend the garment hanger, first sidewalls extending downwardly from said first pair of shoulders, said first pair of shoulders and said first sidewalls lying in a first common plane, rib means connected between the first sidewalls and being bowed outwardly in a first lateral direction from said first common plane to provide form and shape to a garment placed on the hanger, said rib means including at least a first arcuate rib, a second pair of transversely extending shoulders, a second hook coupled between said second pair of shoulders, second sidewalls extending downwardly from said second pair of shoulders, said second pair of shoulders and said second sidewalls lying in a second common plane, all parts lying in respective common planes being shaped and formed to be substantially identical with each other, coupling means for interconnecting the parts in said first common plane to corresponding parts in said second common plane to provide a single integral structure, and at least a second arcuate rib connected between said second sidewalls and bowed outwardly from said second common plane in a second lateral direction opposite to said first lateral direction of said first arcuate rib, whereby at least said first arcuate rib bows outwardly from a front of the hanger and at least said second arcuate rib bows outwardly from a rear of the hanger.

4. A garment hanger consisting of a one-piece, integral structure, said structure being constructed of a continuous unbroken length of pliable resilient material, said material being plastic, said structure comprising a pair of transversely extending shoulders, a hook coupled between said transversely extending shoulders to suspend the garment hanger, sidewalls extending downwardly from said transversely extending shoulders, said transversely extending shoulders and said sidewalls lying in a common plane, rib means securely connected between the sidewalls and being bowed outwardly in only one lateral direction from said common plane to provide form and shape to a garment placed on the hanger, said rib means including at least one arcuate rib disposed in a fixed position relative to said sidewalls, said sidewalls having an upper portion and a lower portion, said upper portion including first arms downwardly depending from an end of each of said transversely extending shoulders, said lower portion including second arms downwardly depending and transversely extending from an end of each of said first arms, at least one reinforcing rib being connected between said sidewalls and lying in said common plane, said one reinforcing rib being spaced apart along said sidewalls from said one arcuate rib to provide structural means for permitting the hanger to be interfittingly nested and stacked with other identical hangers for storage and shipment thereof.

5. A garment hanger as in claim 4 and further comprising waist band holding means disposed on said sidewalls for supporting a waist band of a garment.

6. A garment hanger as in claim 5, wherein said waist band holding means comprises resilient fingers downwardly depending from said upper portion of the sidewalls and lying in said common plane, said resilient fingers having inwardly directed portions to provide a resilient clamp in conjunction with the sidewalls, said resilient clamp being disposed in a vicinity of a junction of said upper portion and said lower portion.

7. A garment hanger as in claim 4, wherein said one arcuate rib is provided on said upper portion and at least another arcuate rib is provided on said lower portion.

* * * * *